US005547525A

United States Patent [19]

Bennett et al.

[11] Patent Number: 5,547,525

[45] Date of Patent: Aug. 20, 1996

[54] ELECTROSTATIC DISCHARGE REDUCTION IN ENERGETIC COMPOSITIONS

[75] Inventors: S. John Bennett, Brigham City; R. Scott Hamilton, Bear River City, both of Utah

[73] Assignee: Thiokol Corporation, Ogden, Utah

[21] Appl. No.: 128,793

[22] Filed: Sep. 29, 1993

[51] Int. Cl.[6] ..... C06B 45/10

[52] U.S. Cl. ..... 149/19.1; 149/19.9; 149/19.91; 149/19.92; 149/108.2; 149/109.6

[58] Field of Search ..... 149/19.1, 19.9, 149/19.91, 108.2, 109.6, 19.92; 428/367

[56] References Cited

U.S. PATENT DOCUMENTS

| | | | |
|---|---|---|---|
| 3,369,943 | 2/1968 | Longwell et al. | 149/18 |
| 3,765,334 | 10/1973 | Rentz et al. | 102/27 R |
| 3,924,405 | 12/1975 | Cohen et al. | 60/219 |
| 4,072,546 | 2/1978 | Winer | 149/19.8 |
| 4,140,561 | 2/1979 | Keith et al. | 149/2 |
| 4,536,235 | 8/1985 | Lelu et al. | 149/19.4 |
| 4,663,230 | 5/1987 | Tennent | 428/367 |
| 4,696,705 | 9/1987 | Hamilton | 149/21 |
| 4,756,251 | 7/1988 | Hightower, Jr. et al. | 102/289 |
| 4,903,604 | 2/1990 | Blewett et al. | 102/364 |
| 4,956,029 | 9/1990 | Hagel et al. | 149/19.8 |
| 5,098,771 | 3/1992 | Friend | 428/209 |
| 5,165,909 | 11/1992 | Tennent et al. | 423/447.3 |
| 5,171,560 | 12/1992 | Tennent | 423/447.3 |

*Primary Examiner*—Donald P. Walsh
*Assistant Examiner*—J. R. Hardee
*Attorney, Agent, or Firm*—Ronald L. Lyons; Madson & Metcalf

[57] ABSTRACT

Conductive carbon fibrils are incorporated into energetic compositions to reduce electrostatic discharge susceptibility. The carbon fibrils are grown catalytically from carbon precursors and are substantially free of pyrolytically deposited thermal carbon. The fibrils generally have a length in the range from about 1μ to about 10μ and a diameter in the range from about 3.5 nanometers to about 75 nanometers. Length to diameter aspect ratios are greater than 5, and typically in the range from about 100:1 to about 1000:1. An effective amount of fibrils is included in the energetic compositions to decrease the resistivity to a level below or on the order of about $10^{10}$ ohm-cm. In most cases, fibril concentration will be in the range from about 0.005 to about 0.1 weight percent.

39 Claims, No Drawings

ELECTROSTATIC DISCHARGE REDUCTION IN ENERGETIC COMPOSITIONS

BACKGROUND OF THE INVENTION

1. Field of the Invention

This invention relates to energetic compositions such as solid propellant, gas generant, and pyrotechnic compositions. More particularly, the invention is directed to compositions and methods for increasing the conductivity of energetic materials and reducing the possibility of premature ignition or explosion due to electrostatic discharge during manufacture, transportation, storage, and use.

2. Technology Background

The sensitivity to electrostatic discharge of energetic compositions, such as solid propellant, gas generant, and pyrotechnic compositions, is well known. Numerous sources of electrical discharge have been cited as possible causes of catastrophic explosion or premature ignition of rocket motors containing solid propellants. External sources include natural lightning, electromagnetic pulses, high power microwave energy, and the like. In addition, static electricity charges are normally present at the interfaces between the various phases in the propellant, insulation, liner and other parts of the rocket motor. Charging of surfaces may occur by surface-to-surface contact (triboelectric contact) and by the cracking or separation of the solid phase, as in fractoelectrification.

Sudden discharge of this electrostatic energy may result in an explosion of materials or generate sufficient heat to ignite the solid propellant. Such catastrophic events have the potential for causing harm to people and property.

One manufacturing operation which has been implicated as a cause of catastrophic discharge and premature propellant ignition is the core pulling operation, i.e., removal of the core molds from the solid propellant grain after the grain is cast. Other manufacturing operations have the potential for causing rapid electrostatic discharge. Such events may also occur during storage, transportation, and deployment of materials or rocket motor.

Composite solid propellants have a very complex microstructure consisting of a dense pack of particles embedded in a polymeric binder matrix. The particles typically comprise fuel, oxidizers, combustion control agents, and the like. The particles may have a wide variety of sizes, shapes and electrical properties. Electrostatic charges typically build up on the binder-filler interfaces, on the grain surface, as well as at the interfaces between other components of the propellant, e.g. at the interface between conductive particles such as aluminum powder and a nonconductive or less-conductive binder.

Certain propellant compositions have a greater conductivity than other compositions. For example, a propellant having a polar polymer may contain dissociated ionic species available for charge transport and would have relatively high conductivity. Such ionic species may be present from ammonium perchlorate dissolved in the polar binder. Electrostatic charges are readily dissipated and catastrophic discharge is unlikely with this type of propellant binder system.

In another propellant, the solid constituents are bound in a polybutadiene/acrylonitrile/acrylic acid terpolymer binder (PBAN). The binder polymer contains polar nitrile functional groups along its backbone. In this system, a quaternary benzyl alkyl ammonium chloride is added to the binder polymer during manufacturing. The polymer and the quaternary ammonium salt together provide a relatively high electrical conductivity.

Another commonly used binder system in solid rocket propellant compositions is hydroxy-terminated polybutadiene (HTPB). In contrast to the PEG and PBAN binder systems, HTPB binders are nonpolar and have an intrinsic high insulation value. Thus, HTPB-based propellants are more susceptible, under certain circumstances, to high charge build-up with the potential for catastrophic electrostatic discharge.

Some pyrotechnic compositions are comprised of solid particles embedded in polymers and are susceptible to electrostatic discharge as are solid propellants. Some pyrotechnic compositions are prepared without binders. The ingredients are either mixed dry or in an evaporative solvent. Dry mixing of pyrotechnic ingredients is particularly susceptible to electrostatic discharge. It is generally known that as air flows across a surface, charge buildup occurs. In dry mixing, there is a very large surface area, creating the potential for charge buildup and electrostatic discharge.

U.S. Pat. No. 3,765,334, granted Oct. 16, 1973 to Rentz et al. reports adding graphite to igniter compositions to prevent electrostatic charge build up. It is reported that at least 16 percent graphite is required to achieve adequate conductivity. Such amounts of graphite adversely affect performance of energetic materials.

U.S. Pat. Nos. 4,072,546 and 4,696,705 report including graphite fibers in solid propellant and gas generant compositions to provide structural reinforcement and burn rate control. However, it is known that even small amounts of graphite fibers markedly increase the processing viscosity of propellant compositions. Even slight increases in viscosity can detrimentally affect processing and propellant rheology.

From the foregoing, it will be appreciated that there is a need in the art for energetic compositions which have sufficient conductivity to reduce electrostatic discharge susceptibility, yet which are processible, retain energetic performance, and retain comparable ballistic, mechanical, and rheological properties. It would also be an advancement in the art to provide methods for reducing electrostatic discharge in energetic compositions.

Such energetic compositions and methods are disclosed and claimed herein.

SUMMARY OF THE INVENTION

The present invention is directed to the use of highly conductive carbon fibrils in energetic compositions for reducing electrostatic discharge susceptibility. The fibrils used in the present invention are different than conventional carbon fibers. In contrast to carbon fibers used in the prior art, the carbon fibrils used in the present invention are grown catalytically from carbon precursors at temperatures well below typical graphitizing temperatures (usually 2900° C.). As a result, the carbon fibrils used in the present invention are substantially free of pyrolytically deposited thermal carbon.

The catalytic synthesis of the carbon fibrils used herein creates ordered layers of graphitic carbon disposed substantially concentrically about the cylindrical axis of the fibril. The carbon fibrils include an inner core region which may be hollow or may contain amorphous carbon atoms.

The carbon fibrils used in the present invention are generally much smaller than the pyrolytically formed fibers of the prior art. The fibrils generally have a length in the range from about 1μ to about 10μ and a diameter in the range from about 3.5 nanometers to about 75 nanometers. Length to diameter aspect ratios in the range from about 100:1 to about 1000:1 are typical for the carbon fibrils used herein.

A sufficient amount of fibrils are included in the energetic compositions to decrease the volume resistivity to a level below or on the order of about $10^{10}$ ohm-cm. The quantity of fibrils needed to lower the resistivity will vary depending upon the conductivity of the fibrils and the specific propellant, gas generant, or pyrotechnic formulation. In most cases, fibril concentration will be in the range from about 0.005 to about 0.1 weight percent. By contrast, significantly higher concentrations of graphite and carbon fibers would be required to achieve the same volume resistivity reduction in existing energetic compositions.

DETAILED DESCRIPTION OF THE INVENTION

The present invention is directed to the use of unique carbon fibrils in energetic compositions for reducing electrostatic discharge susceptibility. As used herein, energetic compositions include propellant, gas generant, and pyrotechnic compositions. The carbon fibrils used in the present invention are to be distinguished from carbon or graphite fibers used in the prior art. Conventional carbon fibers are typically made by pyrolysis of continuous filaments of precursor organic polymers, such as cellulose or polyacrylonitrile, under carefully controlled conditions. Unlike prior art fibers, the carbon fibrils used in the present invention are grown catalytically from carbon precursors without the need for graphitizing temperatures (usually 2900° C.). Thus, the carbon fibrils used in the present invention are substantially free of pyrolytically deposited thermal carbon.

The fibrils preferably contain inner core region surrounded by graphitic layers that are substantially parallel to the fibril axis. One aspect of substantial parallelism is that the projection of the graphite layers on the fibril axis extends for a relatively long distance in terms of the external diameter of the fibril (e.g., at least two fibril diameters, preferably at least five diameters). The inner core region of the fibril may be hollow or may contain carbon atoms which are less ordered (amorphous) than the carbon atoms forming the graphitic layers. The fibrils preferably have diameters between about 3.5 and about 75 nanometers and typically about 15 nanometers. The fibrils usually have a length from about 1μ to about 10μ. The length to diameter aspect ratio is at least 5, and preferably in the range from about 100:1 to about 1000:1.

Suitable carbon fibrils may be obtained from Hyperion Catalysis International, Inc., Massachusetts, which currently sells two grades of carbon fibrils: BN and CC. The CC fibrils are currently preferred. Such carbon fibrils are disclosed in U.S. Pat. Nos. 5,171,560, 5,165,909, 5,098,771, and 4,663,230, which patents are incorporated herein by reference.

It has been found that these carbon fibrils possess excellent conductivity. A conductivity comparison of known conductive carbon materials and the carbon fibrils used herein is shown below in Table 1. The test material (0.5 wt %) was placed in mineral oil and blended for 5 minutes in a Waring blender.

TABLE 1

| Test Material | Volume Resistivity (ohm-cm) |
|---|---|
| Acetylene Black (Chevron) | $1 \times 10^8$ |
| XC-72 (Cabot) | $2 \times 10^6$ |
| EC 300J (Ketjenblack (AKZO)) | $5 \times 10^5$ |
| EC 600JD (Ketjenblack (AKZO)) | $7 \times 10^4$ |
| BN Fibrils | $5 \times 10^3$ |
| CC Fibrils | $1 \times 10^3$ |

The acetylene black, XC-72, EC 300J, and EC 600JD are amorphous carbon particulates obtained by pyrolysis.

Small amounts of the highly-conductive fibrils are incorporated into energetic compositions to render the compositions sufficiently conductive to prevent electrostatic discharge. A sufficient quantity of fibrils is preferably included in the energetic compositions to decrease the volume resistivity of the compositions to a level below or on the order of about $10^{10}$ ohm-cm. In most cases, the fibrils are included in the energetic compositions in the range from about 0.005 to about 2 weight percent, and preferably less than about 0.01 weight percent.

For propellants, the fibrils are preferably included in the range from about 0.01 to about 0.1 weight percent. The quantity of fibrils that can be successfully included in solid propellant compositions must be balanced with increased processing viscosity. Even small amounts of fibrils can significantly increase viscosity and lower pot life for high solids propellant compositions (propellants having more than about 85 wt % solids). While low solids propellant compositions (propellants having less than about 70 wt % solids) can contain a greater fibril content before the viscosity exceeds practical processing levels. Propellant compositions having a solids content greater than about 86 wt %, preferably include fibrils in the range from about 0.01 to about 0.04 weight percent.

For pyrotechnic composition, the fibrils are preferably included in the range from about 0.005 weight percent to about 2 weight percent. Although greater fibril weight percent (up to 20 wt %) is possible in many pyrotechnic compositions, it has been found that in some compositions a fibril content greater than about 0.1 wt % significantly alters the ballistic properties, such as burn rate and plume signature.

The quantity of fibrils needed to achieve adequate volume resistivity reduction is also affected by the energetic composition ingredients. For example, energetic compositions containing a polar binder, polar plasticizer, or various ionizable salts (such as common class 1.1 propellants) will have an inherently lower volume resistivity than energetic composition containing nonpolar ingredients. Equal quantities of fibrils will exhibit a greater change in resistivity in the nonpolar system than in the polar system.

The following examples are given to illustrate various embodiments which have been made or may be made in accordance with the present invention. These examples are given by way of example only, and it is to be understood that the following examples are not comprehensive or exhaustive of the many types of embodiments of the present invention which can be prepared in accordance with the present invention.

EXAMPLE 1

A solid propellant composition (baseline) was prepared containing the following ingredients:

| Ingredient | Weight % |
|---|---|
| HTPB binder | 10.023 |
| IPDI curative | 0.677 |
| DOA | 1.000 |
| HX-752 | 0.300 |
| $Fe_2O_3$ | 0.100 |
| Al (spherical) | 19.000 |
| AP (20μ) | 55.146 |
| AP (200μ) | 13.754 |

The HTPB binder was propellant grade hydroxy-terminated polybutadiene, R-45M. The term "IPDI" refers to isophorone diisocyanate. The term "DOA" refers to dioctyladipate or (2 -ethylhexyl)adipate. The term "HX-752" refers to the widely used aziridine bonding agent, isophthaloyl-bis(m-ethyl-ethyleneimide). The ingredients were mixed in a pint-sized mixer according to conventional propellant mixing procedures. The volume resistivity of the cured propellant composition was measured to be $2.36\times10^{13}$ ohm-cm.

EXAMPLES 2–7

Additional solid propellant compositions were prepared according to the composition of Example 1, except that small amounts of carbon fibrils obtained from Hyperion Catalysis International, Inc. were included in the composition. The fibrils were first dispersed in the DOA by briefly blending the mixture in a Waring blender and then added to the other ingredients. The volume resistivity and time constant of each cured propellant composition were measured and are set forth in Table 2, below. The time constant is a measure of the rate of charge dissipation. Thus, if charge dissipates quicker than it builds up, as evidenced by a low time constant, the potential for electrostatic discharge is reduced.

Although the processing viscosity for the propellant compositions containing carbon fibrils was greater than that of the baseline composition, the end of mix viscosities were still low enough to permit conventional processing and casting.

TABLE 2

Carbon Fibril modified Propellant Compositions

| Example | Carbon Fibril Content (wt %) | Volume Resistivity (ohm-cm) | Carbon Fibril Grade | Time Constant (sec.) |
|---|---|---|---|---|
| 1 | 0.00 | $2.36\times10^{13}$ | — | 14.6 |
| 2 | 0.01 | $5.82\times10^{12}$ | CC | 5.26 |
| 3 | 0.02 | $1.85\times10^{10}$ | CC | 0.027 |
| 4 | 0.03 | $1.51\times10^{10}$ | CC | 0.024 |
| 5* | 0.03 | $6.85\times10^{9}$ | CC | 0.020 |
| 6 | 0.01 | $8.12\times10^{12}$ | DD† | 7.02 |
| 7 | 0.02 | $2.16\times10^{10}$ | DD† | 0.027 |

*gallon-sized mix.
†Hyperion Catalysis International, Inc. is currently including the higher conductive DD fibril within its cc grade fibril.

EXAMPLE 8

A pyrotechnic flare composition was prepared having the following ingredients:

| Ingredient | Weight % |
|---|---|
| Magnesium | 65 |
| PTFE | 19 |
| Viton A ® | 16 |

The magnesium has a –200 +300 mesh particle size. The PTFE (polytetrafluoroethylene), commonly referred to as "Teflon," possesses a bimodal particle size distribution. The Viton A® is a fluorinated ethylene propylene copolymer sold by DuPont. The ingredients were mixed according to conventional pyrotechnic mixing procedures. The volume resistivity of the flare composition was measured and found to be $1.8\times10^{14}$ ohm-cm.

EXAMPLE 9

A pyrotechnic flare composition is prepared according to Example 8, except that the composition includes 0.1 wt % CC carbon fibrils, obtained from Hyperion Catalysis International, Inc., and 64.9 wt % magnesium. It is anticipated that the volumetric resistivity of this pyrotechnic composition is less than about $10^{10}$ ohm-cm.

EXAMPLE 10

A pyrotechnic flare composition is prepared according to Example 8, except that the composition includes 1.0 wt % CC carbon fibrils and 64 wt % magnesium. It is anticipated that the volumetric resistivity of this pyrotechnic composition is less than about $10^{10}$ ohm-cm.

EXAMPLE 11

A pyrotechnic flare composition is prepared according to Example 8, except that the composition includes 0.005 wt % CC carbon fibrils and 64.995 wt % magnesium. It is anticipated that the volumetric resistivity of this pyrotechnic composition is on the order of about $10^{10}$ ohm-cm.

EXAMPLE 12

A pyrotechnic flare composition was prepared having the following ingredients:

| Ingredient | Weight % |
|---|---|
| Magnesium | 40.5 |
| PTFE | 41.4 |
| Viton A ® | 16.1 |
| CC Carbon Fibrils | 2.0 |

The volumetric resistivity of this pyrotechnic composition was measured and found to be $1.34\times10^{4}$ ohm-cm. The analogous flare composition without CC carbon fibrils was prepared and had a volume resistivity of $7\times10^{13}$ ohm-cm.

EXAMPLE 13

A pyrotechnic flare composition is prepared having the following ingredients:

| Ingredient | Weight % |
|---|---|
| Magnesium | 46.95 |
| Ammonium Perchlorate | 20.0 |
| PTFE | 8.2 |
| Carbon (Coke Graphite) | 10.0 |
| HTPB | 12.0 |

-continued

| Ingredient | Weight % |
|---|---|
| IPDI | 1.0 |
| Krytox ® | 1.8 |
| CC Carbon Fibrils | 0.05 |

Krytox® is a fluorinated plasticizer obtained from DuPont. It is anticipated that the volumetric resistivity of this pyrotechnic composition is less than about $10^{10}$ ohm-cm.

EXAMPLE 14

A pyrotechnic smoke composition is prepared having the following ingredients:

| Ingredient | Weight % |
|---|---|
| Terephthalic acid | 55.99 |
| $KClO_3$ | 26.0 |
| $MgCO_3$ | 3.0 |
| Sucrose | 15.0 |
| CC Carbon Fibrils | 0.01 |

It is anticipated that the volumetric resistivity of this pyrotechnic composition on the order of about $10^{10}$ ohm-cm.

From the foregoing it will be appreciated that the present invention provides energetic compositions which have sufficient conductivity to reduce electrostatic discharge susceptibility, yet which are processible, retain energetic performance, and retain comparable ballistic, mechanical, and rheological properties. The present invention also provides methods for reducing electrostatic discharge in energetic compositions.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A propellant composition containing at least 75 weight percent solids in a nonpolar polymeric binder comprising an effective quantity of conductive carbon fibrils sufficient to provide a volume resistivity to a level below or on the order of about $10^{10}$ ohm-cm, wherein said carbon fibrils are present in the propellant composition in the range from about 0.005 to about 0.1 weight percent, said carbon fibrils being catalytically grown and substantially free of pyrolytically deposited thermal carbon.

2. A propellant composition as defined in claim 1, wherein the carbon fibrils have a length in the range from about 1μ to about 10μ.

3. A propellant composition as defined in claim 1, wherein the carbon fibrils have a diameter in the range from about 3.5 nanometers to about 75 nanometers.

4. A propellant composition as defined in claim 1, wherein the carbon fibrils have an aspect ratio in the range from about 100:1 to about 1000:1.

5. A propellant composition as defined in claim 1, wherein the carbon fibrils include an inner core region.

6. A propellant composition as defined in claim 5, wherein the inner core region is hollow.

7. A propellant composition as defined in claim 5, wherein the inner core region contains amorphous carbon atoms.

8. A propellant composition as defined in claim 5, wherein the carbon fibrils possess concentric layers of graphitic carbon disposed substantially concentrically about the inner core region.

9. A propellant composition as defined in claim 1, wherein the solid propellant composition contains more than 85 weight percent solids.

10. A propellant composition as defined in claim 9, wherein the carbon fibrils are present in the range from about 0.01 to about 0.04 weight percent.

11. A propellant composition as defined in claim 10, wherein the carbon fibrils have a length in the range from about 1μ to about 10μ and a diameter in the range from about 3.5 nanometers to about 75 nanometers.

12. A propellant composition comprising conductive carbon fibrils present in the propellant composition in the range from about 0.005 weight percent to about 0.1 weight percent, said carbon fibrils being catalytically grown and substantially free of pyrolytically deposited thermal carbon.

13. An energetic composition as defined in claim 12, wherein the carbon fibrils have a length in the range from about 1μ to about 10μ.

14. An energetic composition as defined in claim 12, wherein the carbon fibrils have a diameter in the range from about 3.5 nanometers to about 75 nanometers.

15. An energetic composition as defined in claim 12, wherein the carbon fibrils include an inner core region.

16. An energetic composition as defined in claim 15, wherein the inner core region is hollow.

17. An energetic composition as defined in claim 15, wherein the inner core region contains amorphous carbon atoms.

18. An energetic composition as defined in claim 15, wherein the carbon fibrils possess concentric layers of graphitic carbon disposed substantially concentrically about the cylindrical axis of the fibril.

19. A propellant composition containing at least 75% solids comprising conductive carbon fibrils having a diameter in the range from about 3.5 nanometers to about 75 nanometers, said carbon fibrils being catalytically grown and substantially free of pyrolytically deposited thermal carbon, wherein the carbon fibrils are present in the propellant composition in the range from about 0.01 to about 0.1 weight percent.

20. A propellant composition as defined in claim 19, wherein the carbon fibrils include an inner core region and possess concentric layers of graphitic carbon disposed substantially concentrically about said inner core region.

21. A propellant composition as defined in claim 19, wherein the carbon fibrils have a length in the range from about 1μ to about 10μ.

22. A propellant composition containing at least 65 weight percent solids in a polar polymeric binder comprising conductive carbon fibrils having a diameter in the range from about 3.5 nanometers to about 75 nanometers, wherein said carbon fibrils are present in the propellant composition in the range from about 0.01 to about 0.1 weight percent, said carbon fibrils being catalytically grown and substantially free of pyrolytically deposited thermal carbon.

23. A propellant composition as defined in claim 22, wherein the carbon fibrils include an inner core region and possess concentric layers of graphitic carbon disposed substantially concentrically about said inner core region.

24. A propellant composition as defined in claim 22, wherein the carbon fibrils have a length in the range from about 1μ to about 10μ.

25. A method for reducing electrostatic discharge susceptibility in a propellant composition containing at least 75 weight percent solids in a nonpolar polymeric binder comprising incorporating into said propellant composition an effective quantity of conductive carbon fibrils sufficient to provide a volume resistivity to a level below or on the order of about $10^{10}$ ohm-cm, wherein said carbon fibrils are incorporated into the propellant composition in the range from about 0.005 to about 0.1 weight percent, said carbon fibrils being catalytically grown and substantially free of pyrolytically deposited thermal carbon.

26. A method for reducing electrostatic discharge susceptibility as defined in claim 25, wherein the carbon fibrils have a length in the range from about 1μ to about 10μ.

27. A method for reducing electrostatic discharge susceptibility as defined in claim 25, wherein the carbon fibrils have a diameter in the range from about 3.5 nanometers to about 75 nanometers.

28. A method for reducing electrostatic discharge susceptibility as defined in claim 25, wherein the solid propellant composition contains more than 85 weight percent solids.

29. A method for reducing electrostatic discharge susceptibility as defined in claim 28, wherein the carbon fibrils are present in the range from about 0.01 to about 0.04 weight percent.

30. A method for reducing electrostatic discharge susceptibility in an energetic composition comprising incorporating into said energetic composition conductive carbon fibrils in the range from about 0.005 weight percent to about 0.1 weight percent, said carbon fibrils being catalytically grown and substantially free of pyrolytically deposited thermal carbon.

31. A method for reducing electrostatic discharge susceptibility as defined in claim 30, wherein the carbon fibrils include an inner core region and possess concentric layers of graphitic carbon disposed substantially concentrically about said inner core region.

32. A method for reducing electrostatic discharge susceptibility as defined in claim 30, wherein the carbon fibrils have a length in the range from about 1μ to about 10μ.

33. A method for reducing electrostatic discharge susceptibility as defined in claim 30, wherein the carbon fibrils have a diameter in the range from about 3.5 nanometers to about 75 nanometers.

34. A method for reducing electrostatic discharge susceptibility as defined in claim 30, wherein the energetic composition is a pyrotechnic composition.

35. A method for reducing electrostatic discharge susceptibility as defined in claim 30, wherein the energetic composition is a propellant composition.

36. A method for reducing electrostatic discharge susceptibility in propellant composition containing at least 75 weight percent solids comprising incorporating into said propellant composition conductive carbon fibrils having a diameter in the range from about 3.5 nanometers to about 75 nanometers, wherein said carbon fibrils are incorporated into the propellant composition in the range from about 0.01 to about 0.1 weight percent, said carbon fibrils being catalytically grown and substantially free of pyrolytically deposited thermal carbon.

37. A method for reducing electrostatic discharge susceptibility as defined in claim 36, wherein the carbon fibrils include an inner core region and possess concentric layers of graphitic carbon disposed substantially concentrically about said inner core region.

38. A method for reducing electrostatic discharge susceptibility as defined in claim 36, wherein the carbon fibrils have a length in the range from about 1μ to about 10μ.

39. A method for reducing electrostatic discharge susceptibility in a propellant composition containing at least 65 weight percent solids in a polar polymeric binder comprising incorporating into said energetic composition conductive carbon fibrils having a diameter in the range from about 3.5 nanometers to about 75 nanometers, wherein said carbon fibrils are incorporated into the propellant composition in the range from about 0.005 to about 0.1 weight percent, said carbon fibrils being catalytically grown and substantially free of pyrolytically deposited thermal carbon.

* * * * *